US012285066B2

(12) United States Patent
Molina et al.

(10) Patent No.: US 12,285,066 B2
(45) Date of Patent: Apr. 29, 2025

(54) CLOTHING FOR CONCEALED CARRY ACCESS

(71) Applicant: Tarnkappe Gear LLC, Dallas, TX (US)

(72) Inventors: Gustavo Molina, Dallas, TX (US); Roberto Edmundo Nuñez Mateo, Tegucigalpa (HN)

(73) Assignee: Tarnkappe Gear LLC, Dallas, TX (US)

( * ) Notice: Subject to any disclaimer, the term of this patent is extended or adjusted under 35 U.S.C. 154(b) by 0 days.

(21) Appl. No.: 18/505,088

(22) Filed: Nov. 8, 2023

(65) Prior Publication Data

US 2024/0148089 A1 May 9, 2024

Related U.S. Application Data

(60) Provisional application No. 63/423,618, filed on Nov. 8, 2022.

(51) Int. Cl.

| | |
|---|---|
| ***A41F 1/02*** | (2006.01) |
| ***A41B 1/02*** | (2006.01) |
| ***A41B 1/10*** | (2006.01) |
| ***A41B 1/18*** | (2006.01) |
| ***A41D 27/20*** | (2006.01) |

(52) U.S. Cl.

CPC ..... *A41F 1/02* (2013.01); *A41B 1/02* (2013.01); *A41B 1/10* (2013.01); *A41B 1/18* (2013.01); *A41D 27/20* (2013.01)

(58) Field of Classification Search

CPC . A41D 1/02; A41D 1/18; A41D 27/20; A41D 2300/324; A41B 1/00; A41B 1/02; A41B 1/08; A41B 1/10; A41B 1/18; A41B 1/20; A41F 1/02

USPC ..... 2/77, 265, 266

See application file for complete search history.

(56) References Cited

U.S. PATENT DOCUMENTS

| | | | | |
|---|---|---|---|---|
| 886,924 | A * | 5/1908 | Bernstein | A41F 1/02 24/659 |
| 2004/0216212 | A1* | 11/2004 | Newman | A41D 13/129 2/69 |
| 2011/0231982 | A1* | 9/2011 | Echikson | F41C 33/046 2/272 |
| 2014/0259270 | A1* | 9/2014 | Lepovitz | A45F 5/02 2/69 |
| 2019/0335825 | A1* | 11/2019 | Green | A41D 13/0012 |
| 2021/0106083 | A1* | 4/2021 | Spiegle | A41D 13/1236 |

FOREIGN PATENT DOCUMENTS

| | | | | |
|---|---|---|---|---|
| JP | S6045302 U | * | 3/1985 | |
| KR | 20150105775 A | * | 9/2015 | A41B 1/10 |
| KR | 20210063950 A | * | 6/2021 | A41B 1/10 |

* cited by examiner

*Primary Examiner* — Aiying Zhao

(57) ABSTRACT

An article of clothing including outer and inner plackets. The outer placket including hole embroideries evenly spaced on an outer layer, non-functional visible fasteners applied to a first subset of the hole embroideries, and first fasteners offset from the hole embroideries. The inner placket including second fasteners configured to extend through a second subset of the hole embroideries and third fastener configured to couple with the first fasteners.

10 Claims, 7 Drawing Sheets

CLOTHING FOR CONCEALED CARRY ACCESS

CROSS-REFERENCE TO RELATED APPLICATIONS

This application claims the benefit of U.S. Provisional Application No. 63/423,618, filed Nov. 8, 2022, entitled CLOTHING FOR CONCEALED CARRY ACCESS, which is incorporated by reference herein in its entirety.

TECHNICAL FIELD

This disclosure relates generally to articles of clothing. More specifically, this disclosure relates to clothing for concealed carry access.

BACKGROUND

Conventional clothing directed to concealed carry applications can be clearly identifiable due to bulkiness or other factors. Identifying a person that is concealed carrying can defeat the purpose and cause unwanted effects on a person. The range of unwanted effects can go from the most extreme of being a target to milder effects of being treated poorly by non-concealed carrying people. Improvements to concealed carry clothing applications is needed.

SUMMARY

This disclosure provides an article of clothing for concealed carry access.

In a first embodiment, an article of clothing includes a body outer front and a body inner front. The body outer front has an outer placket that includes an outer layer, an inner layer, a support layer, a plurality of hole embroideries, a plurality of non-functional visible fasteners, a plurality of first fasteners, and a pocket. The outer layer faces an outside of the article of clothing. The inner layer faces an interior of the article of clothing. The support layer is positioned between the outer layer and the inner layer. The plurality of hole embroideries are evenly spaced on the outer layer and includes a first set of hole embroideries and a second set of hole embroideries. The first set of hole embroideries is formed on the outer layer and extends through the inner layer and the support layer and each hole embroidery includes a hole cut through a center that extends through the outer layer, the inner layer and the support layer. The second set of hole embroideries is formed on the outer layer, where the second set of hole embroideries does not include a hole cut through a center of each hole embroidery. The plurality of non-functional visible fasteners is mounted to the outer layer, where each of the non-functional visible fasteners is mounted to the outer layer over a respective hole embroidery of the second set of hole embroideries and is coupled to the outer layer by a thread extending through the outer layer and support layer, where the thread does not extend through the inner layer. The plurality of first fasteners is applied to an inner layer. Each of the plurality of first fasteners includes an eyelet and a stud. The eyelet is positioned between the outer layer and the support layer. The stud is coupled to the eyelet through the inner layer and the support layer. The pocket is positioned near a bottom of the outer placket and formed by cutting a hole in the inner layer. The body inner front has an inner placket that includes a plurality of second fasteners and a plurality of third fasteners. The plurality of second fasteners is positioned on a surface of the inner placket facing the outer placket at a spacing that is the same as a spacing for the plurality of hole embroideries. Each second fastener is positioned in line with a respective hole embroidery of the first set of hole embroideries and configured to be selectively coupled through the respective hole embroidery of the first set of hole embroideries. The plurality of third fasteners is positioned on the surface of the inner placket facing the outer placket. Each third fastener is aligned with a corresponding first fastener of the outer placket and configured to couple with the corresponding first fastener of the outer placket, each of the plurality of third fasteners includes a socket and a cap. The socket is positioned on the surface of the inner placket facing the outer placket and configured to couple with a corresponding stud. The cap positioned on an opposite surface of the inner placket and coupled to the socket through the inner placket.

Other technical features may be readily apparent to one skilled in the art from the following figures, descriptions, and claims.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 8, described below, and the various embodiments used to describe the principles of the present disclosure are by way of illustration only and should not be construed in any way to limit the scope of the disclosure. Those skilled in the art will understand that the principles of the present disclosure may be implemented in any type of suitably arranged device or system.

FIGS. 1 through 5 illustrate an example concealed carry clothing 100 in accordance with this disclosure. The concealed carry clothing 100 illustrated in FIGS. 1 through 5 is for illustration only. FIGS. 1 through 5 do not limit the scope of this disclosure to any particular implementation of a garment.

Figure 1:
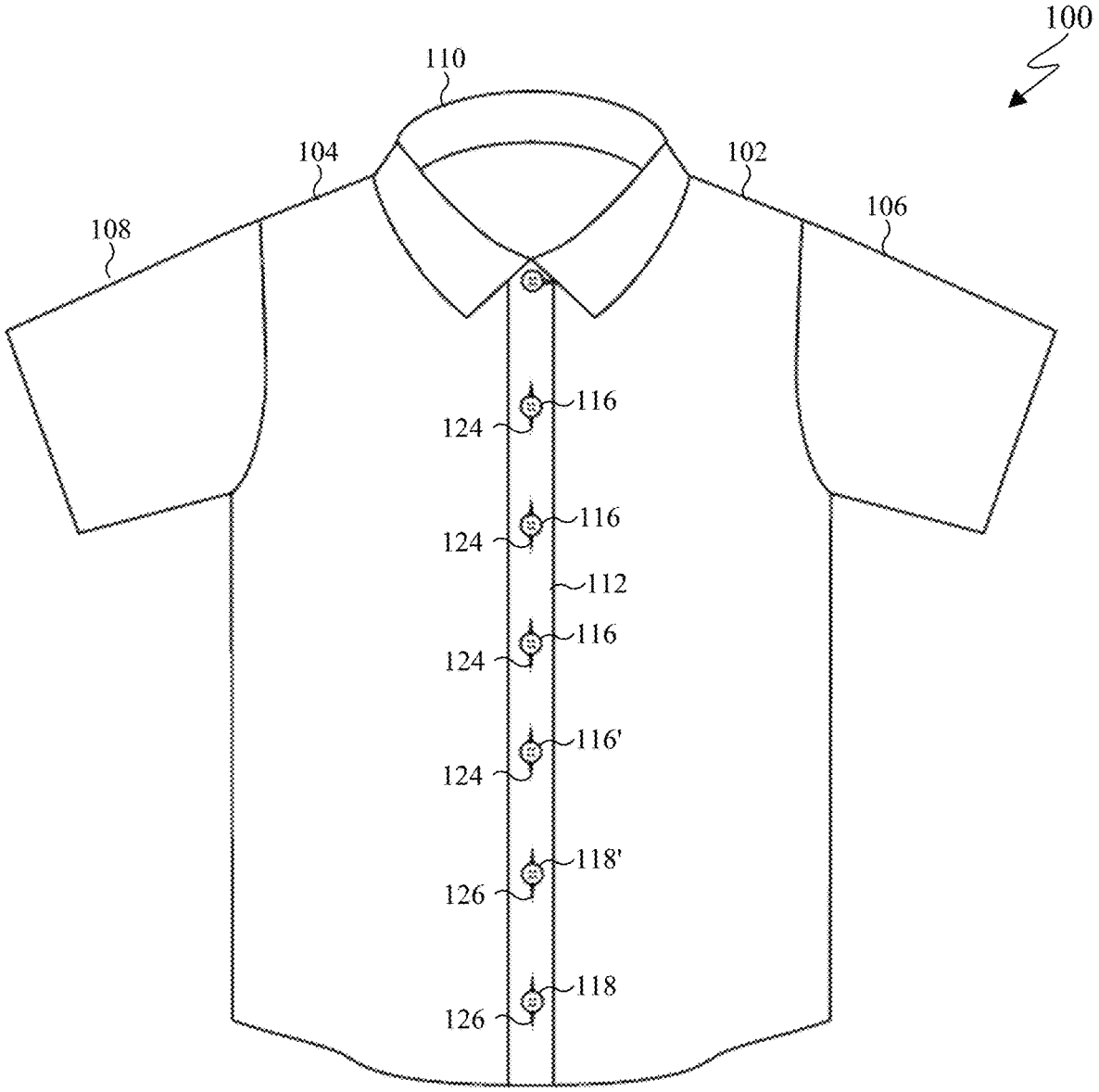
FIG. 1 shows one embodiment of a concealed carry clothing in accordance with this disclosure in a closed configuration with all fasteners coupled.
Figure 2:
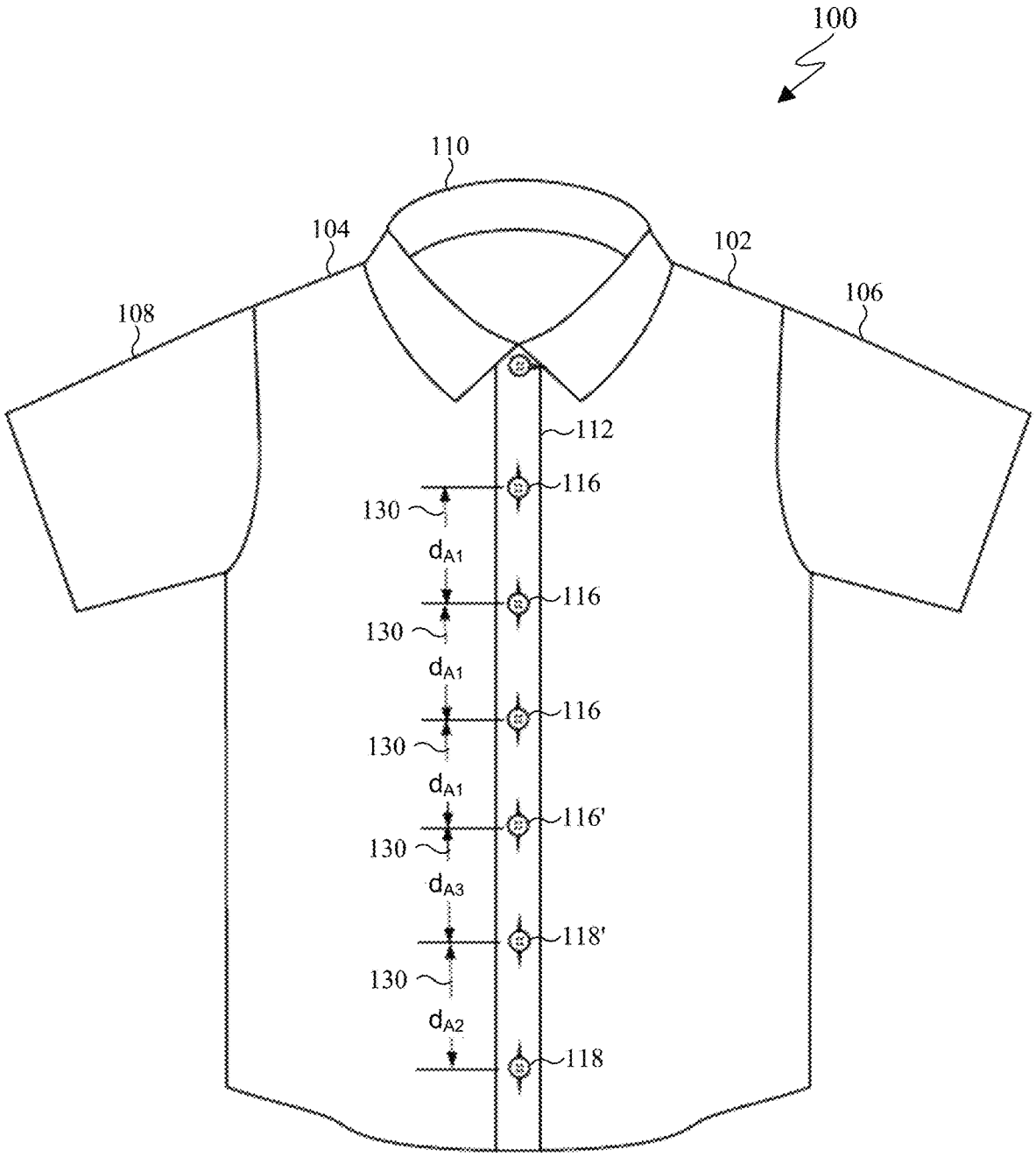
FIG. 2 shows the clothing of FIG. 1 illustrating various fastener placement intervals in accordance with another aspect.
Figure 3:
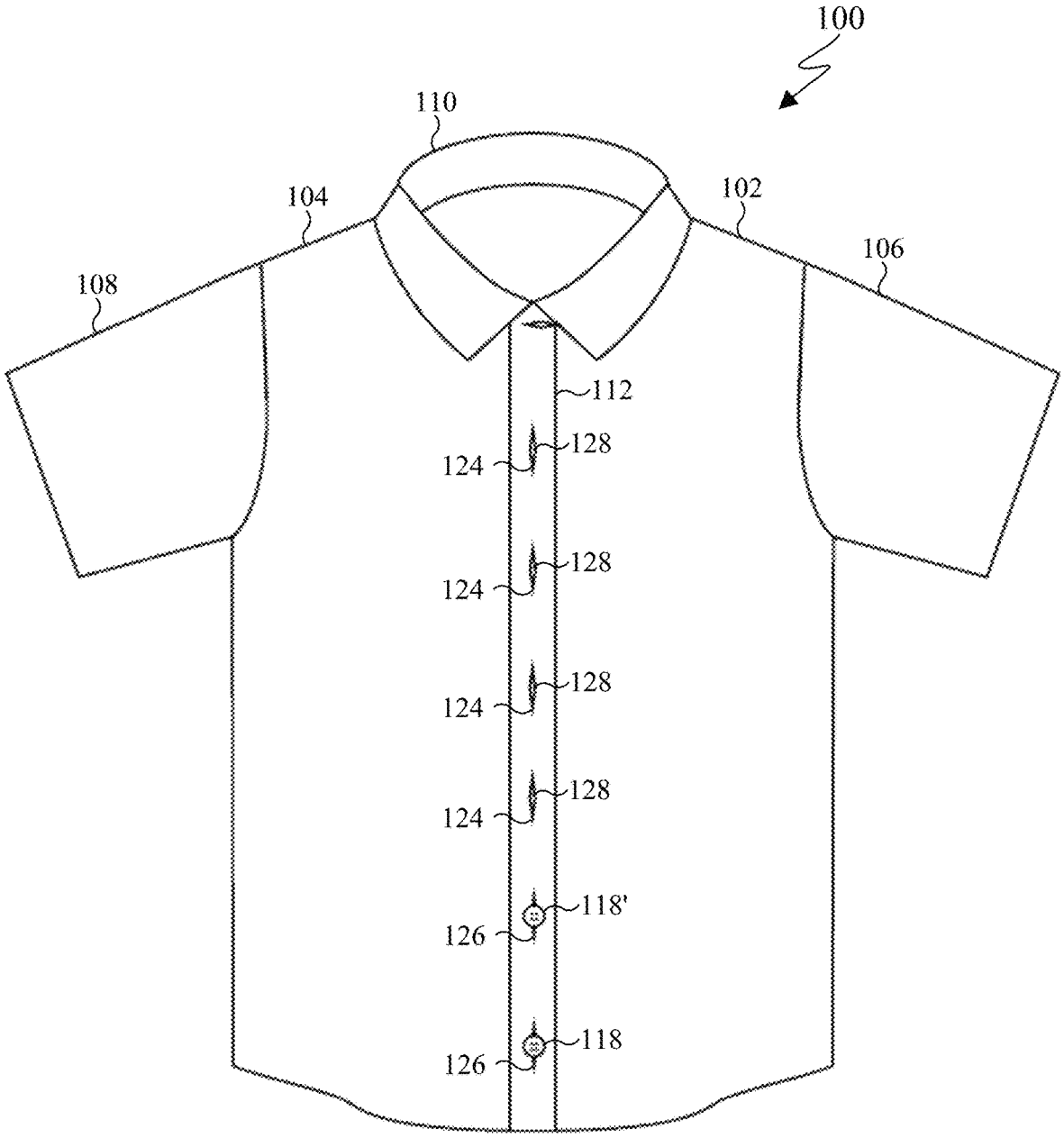
FIG. 3 shows the clothing of FIG. 1 in a closed configuration with all fasteners uncoupled.
Figure 4:
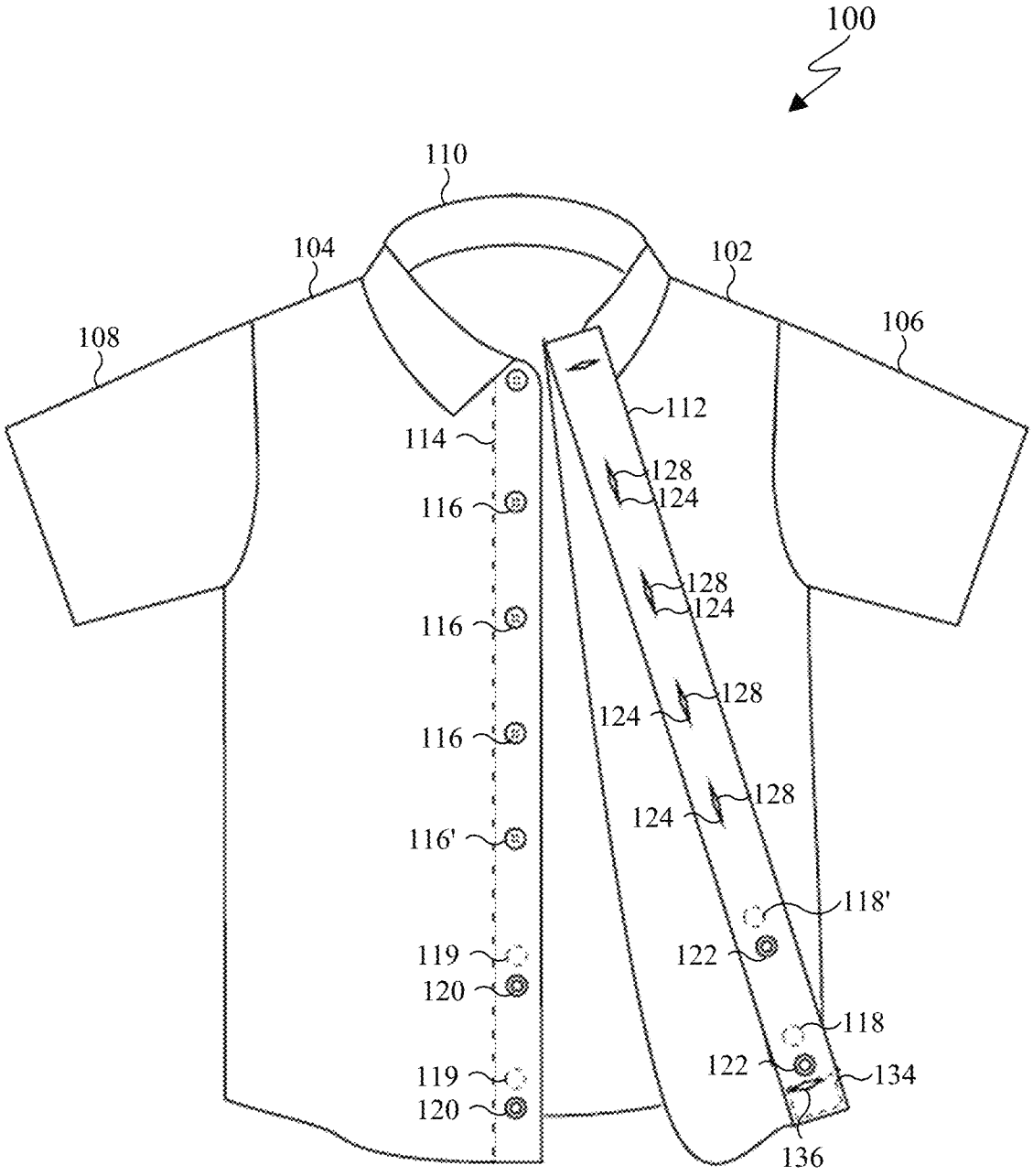
FIG. 4 shows the clothing of FIG. 1 in an open configuration with all fasteners uncoupled.

The embodiment of concealed carry clothing 100 illustrated in FIGS. 1-5 is configured to have an exterior appearance of a shirt; however, other embodiments of the disclosed concealed carry clothing can have an exterior appearance of any standard clothing. As shown in FIG. 1, the concealed carry clothing 100 can have a body 101 defining a body outer front 102, a body inner front 104, a first sleeve 106, a second sleeve 108, a collar 110, an outer placket 112 and an inner placket 114 (FIG. 4). The body outer front 102, the body inner front 104, the first and second sleeves 106 and 108, the collar 110, and the outer and inner plackets 112 and 114 can be made of any suitable material(s) and any suitable color(s).

The concealed carry clothing 100 can also have a plurality of visible fasteners 116 and 118, concealed fasteners 120 and 122 (FIG. 4), a plurality of hole embroideries 124 and 126, and a plurality of holes 128 (FIG. 4). For purposes of this application, unless otherwise expressly indicated, the terms "visible" and "concealed" refer to whether the element in question is viewable on the exterior of the clothing when the plackets 112 and 114 are placed together and selectively coupled to one another by engaging the functional fasteners to their intended counterparts (e.g., buttons engaged in buttonholes or snap sections engaged to one another). The visible fasteners 116 and 118 can be the same type of fasteners aesthetically. As an example, the visible fasteners 116 and 118 can be identical buttons that allow the concealed carry clothing 100 to look like any ordinary clothing.

As shown in FIG. 2, the visible fasteners 116 and 118 can have a uniform spacing 130 (i.e., the distance between adjacent fasteners). For a standard appearance of the concealed carry clothing 100, the visible fasteners 116 and 118 can have a spacing in a range of 2.0 to 3.5 inches. The spacing between visible fasteners 116 and fasteners 118 can also be the same as the spacing between each of the visible fasteners 116 and 118. Uniform spacing between the visible fasteners 116 and 118 allows for the clothing 100 to not be aesthetically identifiable from other clothing. For example, as best seen in FIG. 2, the concealed carry clothing 100 of the illustrated embodiment has a first uniform spacing (denoted $d_{A1}$) between the adjacent functional visible fasteners 116, a second uniform spacing (denoted $d_{A2}$) between the adjacent non-functional visible fasteners 118, and a third spacing (denoted $d_{A3}$) between the adjacent functional visual and non-functional visual fasteners 116' and 118'. In this illustrated embodiment, the spacings $d_{A1}$, $d_{A2}$ and $d_{A3}$ all have equal values, i.e., $d_{A1}=d_{A2}=d_{A3}$, thereby providing an external appearance of the visible fasteners 116 and 118 that is similar to conventional non-concealed carry clothing.

As illustrated in FIGS. 3 and 4, the clothing 100 is shown with the fasteners 116, 120, and 122 unengaged and uncoupled. The fasteners 116, 120, and 122 are functional, i.e., able to selectively couple the body inner front 104 to the body outer front 102, while fasteners 118 are not functional ("non-functional"), i.e., not able to selectively couple the body inner front 104 to the body outer front 102. For purposes of this application, unless otherwise expressly indicated, the terms "functional" and "non-functional" refer to whether the element in question as configured on the clothing acts to selectively couple or release the plackets 112 and 114. For example, in some embodiments, fasteners 116 and 118 can be identical buttons; however, buttons 116 are termed "functional" fasteners because they are affixed on the outer surface of the inner placket 114, allowing selective insertion through corresponding buttonholes 128 on the outer placket 112 to selectively couple the two plackets together, whereas buttons 118 are termed "non-functional" fasteners because they are affixed on the outer surface of the outer placket 112 and thus cannot act to couple the two plackets together. To be certain, the "non-functional" buttons 118 are important to the clothing's primary purpose of concealment by serving to mimic conventional buttons; however, they are non-functional with respect to selective coupling of the plackets.

Referring still to FIG. 4, the fasteners 116 and 120 are affixed (i.e., permanently coupled) to the inner placket 114 and the fasteners 118 and 122 are affixed to the outer placket 112. The fasteners 116 and 120 are affixed to an outer (i.e., "front") side of the inner placket 114. Fasteners 118 are affixed to an outer (i.e., "front") side of the outer placket 112 and fasteners 122 are affixed to an inner (i.e., back) side of the outer placket 112.

The concealed fasteners 120 and 122 can be used to cooperatively selectively couple the outer and inner plackets 112 and 114 in areas adjacent to the non-functional fasteners 118. The concealed (i.e., "non-visible") fasteners 120 and 122 are hidden from view or exposure from outside the clothing 100 when the outer and inner plackets 112 and 114 are coupled. This is accomplished by attaching fastener 122 to the inner side of the outer placket 112 and by partially extending or coupling through the outer placket 112 or not completely extending and coupling through the outer placket 112. Examples of concealed fasteners 120 and 122 can include snaps, press studs, hook and loop tape, poppers, magnets, grommets, and eyelets. The purpose of concealed fasteners 120 and 122 is for selectively coupling and releasing the body outer front 104 from the body inner front 102 without damage to the garment or fasteners when the outer and inner plackets 112 and 114 are forcibly separated. For example, pulling at least one of the outer and inner plackets 112 and 114 can cause the coupling of fasteners 120 and 122 to be released.

Figure 5:
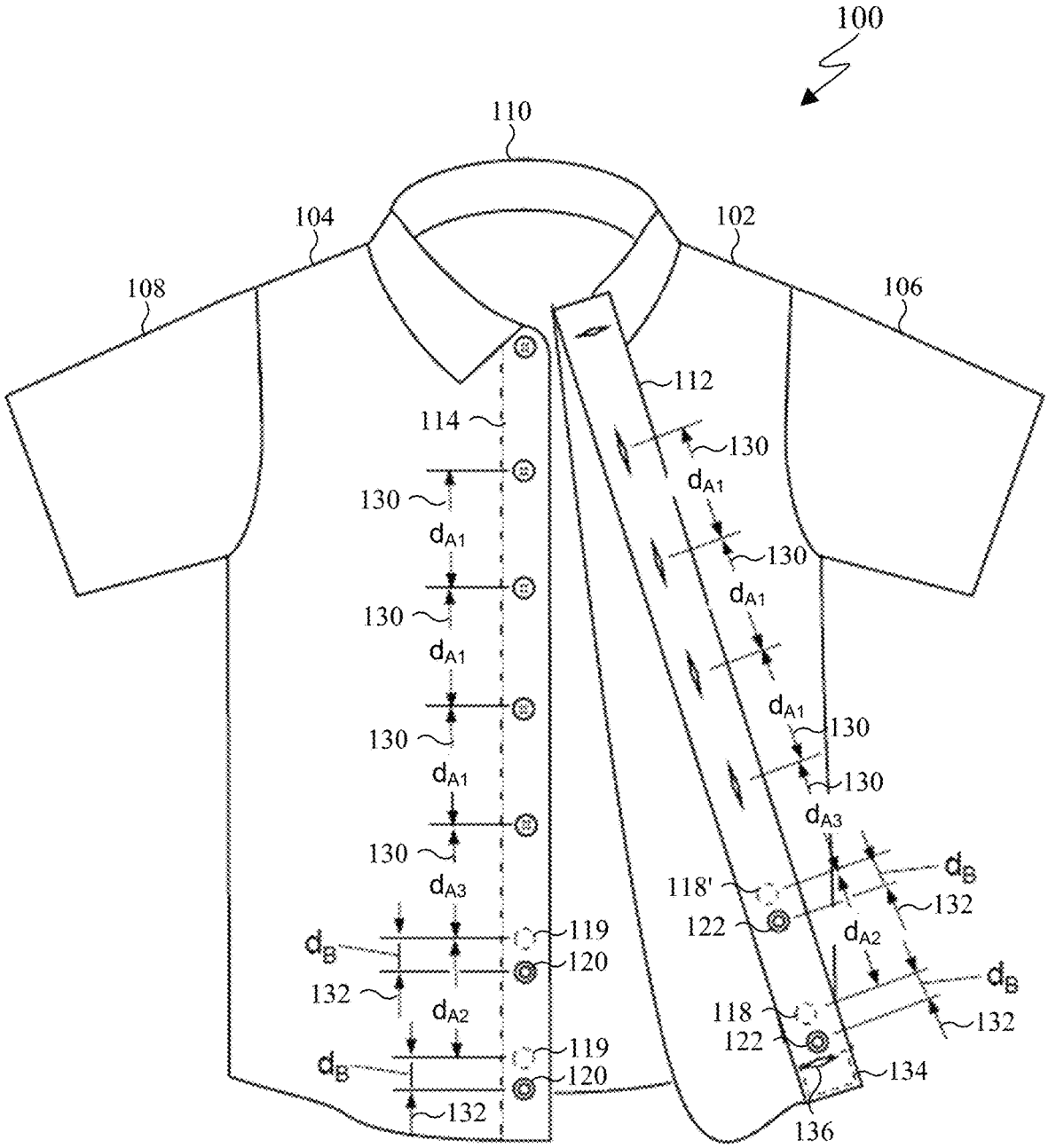
FIG. 5 shows the clothing of FIG. 1 illustrating various fastener, embroidery and hole placement intervals in accordance with another aspect.

The fasteners 118, 120, and 122 can be positioned at the bottom or distal portion (i.e., relative to the collar 110) of the outer and inner plackets 112 and 114 and the fasteners 116 can be positioned on the proximal portion (i.e., relative to the collar) of the inner placket 114 above the fasteners 118, 120, and 122. The visible fasteners 116 and 118 are different from the concealed fasteners 120 and 122. As best seen in FIGS. 4 and 5, the positions of the functional non-visible fasteners 122 on the back side of outer placket 112 are offset from the positions of the non-functional visible fasters 118 on the front side of the outer placket, and the positions of the functional non-visible fasteners 120 on the front side of the inner placket 114 are similarly offset from the projected position 119 of the non-functional visible fasteners 118 when overlying the inner placket 114.

For example, in the embodiment of concealed carry clothing 100 illustrated in FIG. 5, the functional concealed fasteners 120 and 122 can be positioned with an offset 132 (with value dB) from the corresponding non-functional visible fasteners 118 and their projected positions 119. Without the offset 132, the thickness or height of the concealed fasteners 120 and 122 could cause the visible fastener 118 to protrude excessively from the outer surface of the outer placket 112 in a manner (e.g., more than the functional fasteners 116 when engaged) that could identify the clothing 100 as a concealed carry clothing. The offset 132 can be at least a distance dB equal to a radius of the fastener 118 added to a radius of the fastener 122. The distance dB of each offset 132 for each respective concealed fastener 122 from a respective visible fastener 118 can vary since the position of the concealed fasteners cannot be seen when the clothing is closed.

Referring again to FIG. 3, the outer placket 112 can include a plurality of hole embroideries 124 and 126 (e.g., buttonhole stitching). The positions of the hole embroideries 124 can correspond to the positions of functional visible fasteners 116 and the positions of the hole embroideries 126 can correspond to the locations of the non-functional visible fasteners 118. The hole embroideries 124 and 126 can be made of the same material and sizes. The respective hole embroideries 124 and 126 can use the same spacings 130 as the respective fasteners 116 and 118. The hole embroideries 124 can be sewn through the entire outer placket 112. The hole embroideries 126 can be sewn partially or entirely through the outer placket 112, while the hole embroideries are preferably sewn partially through the outer placket 112 from an outer side of the outer placket 112. Holes 128 (e.g., buttonholes) are cut through a center of each of the hole embroideries 124 to allow selective passage therethrough of the functional visible fasteners 116. Holes may be cut, but are not required, through the hole embroideries 126, since these embroideries serve only to further the appearance of the clothing for conceal carry purposes.

Figure 7:
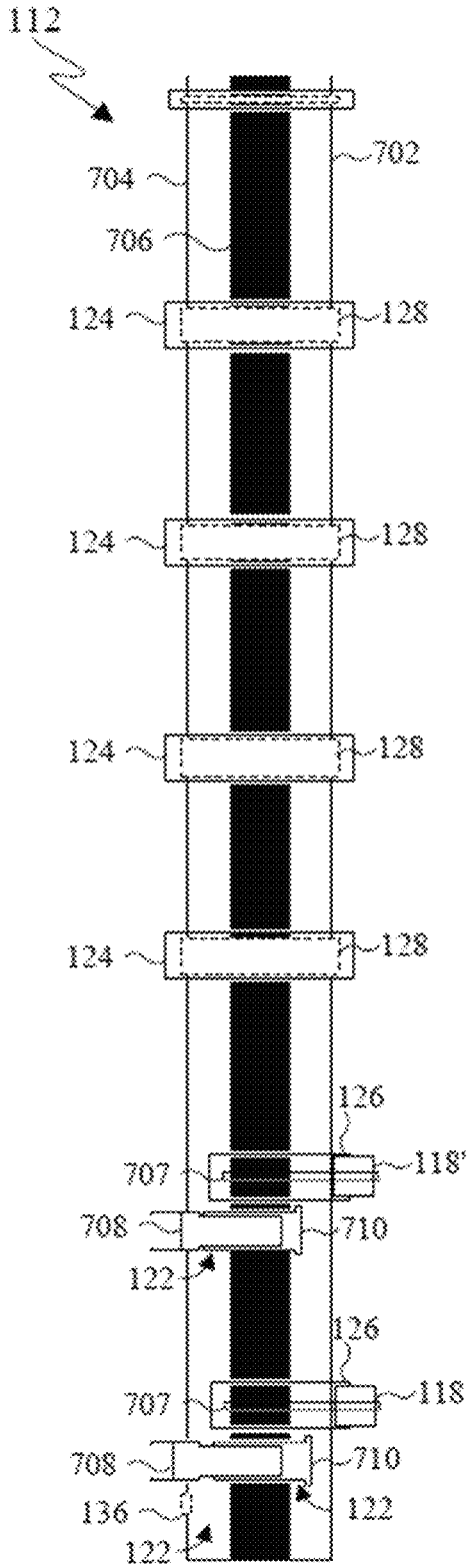

In certain embodiments, the outer placket 112 includes a support layer, such as support layer 706 shown in FIG. 7. The support layer stiffens the outer placket 112 and can increase a life of the clothing 100 from repeated pulling on the outer and inner plackets 112 and 114 that could damage (such as rips or tears) in the outer placket 112 or the inner placket 114. The support layer can also aesthetically negate extra thickness of the concealed fasteners 120 and 122 in order to not be noticeable when the outer and inner plackets 112 and 114 are coupled.

The outer placket 112 can also include a concealed pocket 134 that is formed by cutting a hole 136 in an inside surface of the outer placket 112. A stiffness of the support layer may cause a bottom of the outer placket 112 to bend away from the inner placket 114 when the outer and inner plackets 112 and 114 are coupled. The hole 136 allows for a weighted item (not shown) to be placed in the pocket 134 in order to keep the bottom of the outer placket 112 hanging against the inner placket 114 when the outer and inner plackets 112 and 114 are coupled. The item can be removed from the pocket 134 through the hole 136 when suitable, for example, washing the clothing 100.

In another aspect, a wearer of the clothing 100 illustrated in FIGS. 1 through 5 can utilize the clothing in a concealed carry situation as follows: The wearer can use a first hand to pull sharply on one of the outer and inner plackets 112, 114 or one of the adjacent outer and inner body fronts 102, 104 to cause the concealed fasteners 120, 122 to release from one another. Now that a lower portion of one body front (e.g., body front 104) is uncoupled from a lower portion of the other body front (e.g., body front 102), i.e., those lower portions being previously joined by the concealed fasteners 120, 122, the wearer can selectively raise one of the uncoupled lower portions to uncover the concealed carry item (not shown) to allow the wearer to access the concealed carry item using a second hand. Upper portions of the body fronts 102, 104 of the clothing 100, i.e., those portions secured by the functional fasteners 116 engaged through the holes 128, can remain secured together while the wearer is accessing the concealed carry item.

Although FIGS. 1 through 5 illustrate one exemplary embodiment of a concealed carry clothing 100, various changes may be made in other embodiments. For example, the embodiment of the shirt 100 shown in FIGS. 1-5 includes two concealed fasteners/snaps 120 provided on the inner placket 114 below the functional buttons 116. Other embodiments, for example different size shirts, may have a different number of concealed fasteners/snaps 120 on the inner placket 114 below the functional buttons 116. For example, in a smaller-size shirt embodiment, only one concealed fastener/snap 120 may be provided on the inner placket 114 below the functional buttons 116, whereas in a larger-size shirt embodiment, three or more concealed fasteners/snaps may be provided on the placket below the functional buttons. In still further examples, while the illustrated clothing 100 is a shirt, in other embodiments the clothing components and arrangements can be configured as a vest, jacket, blouse, or other article of clothing worn on a torso. Also for example, the amount and placement of the various components of the clothing 100 can vary as needed or desired.

Figure 6:
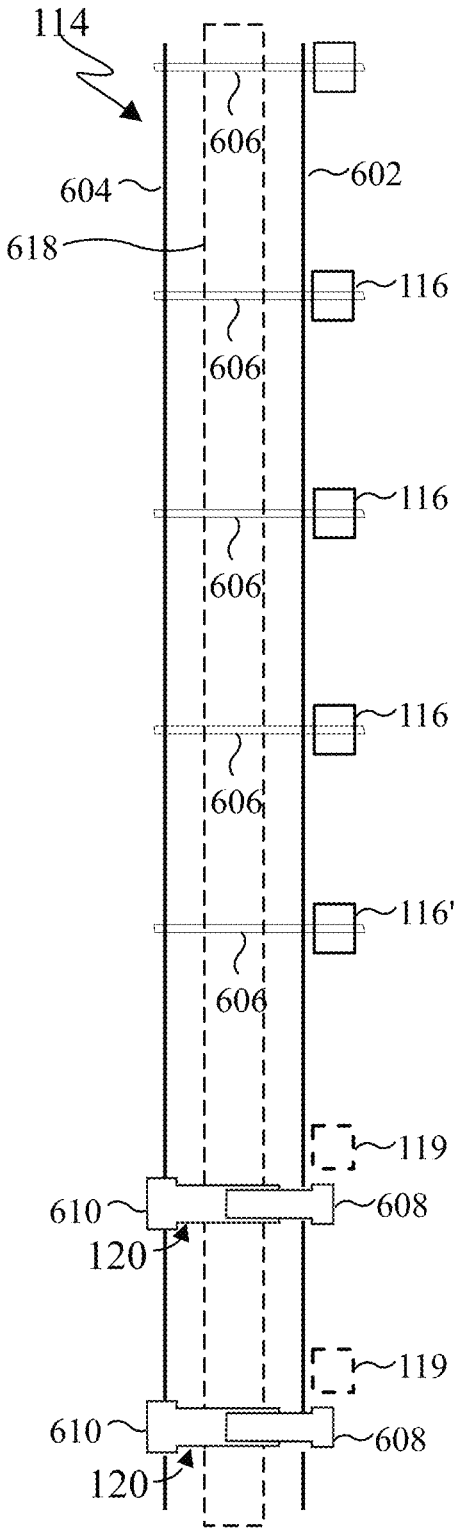
FIGS. 6 and 7 illustrate a cross section of example inner and outer plackets in accordance with this disclosure, where the cross section is taken through a centerline of each respective placket.

FIGS. 6 and 7 illustrate respective cross sections of example embodiments of respective outer and inner plackets 112 and 114 in accordance with this disclosure. In particular, FIG. 6 illustrates a cross section of an inner placket 114 and FIG. 7 illustrates a cross section of an outer placket 112. The embodiments of the outer and inner plackets 112 and 114 illustrated in FIGS. 6 and 7 are not shown to scale, i.e., the relative sizes, thicknesses and/or proportions of the various elements are adjusted for purposes of better illustrating the components and their configurations. FIGS. 6 and 7 do not limit the scope of this disclosure to any particular implementation of a clothing 100.

As shown in FIG. 6, the inner placket 114 can have an outer layer 602 and an inner layer 604. The outer layer 602 or the inner layer 604 can be formed by folding a portion of the body inner front 104. A seam can be sewn into a leading edge of the folded portion.

The functional visible fasteners 116 can be mounted to the outer layer 602 of the inner placket 114. In certain embodiments, the fasteners 116 can be sewn on using thread 606. The thread 606 can be sewn through both of the outer and inner layers 602 and 604.

The concealed fasteners 120 can be coupled through the outer and inner layers 602 and 604 of the inner placket 114. The fasteners 120 can include a socket 608 and a cap 610. The cap 610 can extend through the outer and inner layers 602 and 604 to couple with the socket 608. For reference, shown in dotted line in FIG. 6 are the locations (denoted 609) at which functional fasteners would be located in a conventional garment.

As shown in FIG. 7, the outer placket 112 can have an outer layer 702, an inner layer 704, and a support layer 706. The outer layer 702 or the inner layer 704 can be formed by folding a portion of the body outer front 102 (e.g., folding the edge upon itself). The support layer 706 can be positioned between the outer layer 702 and the inner layer 704 before a seam is sewed along an edge of the folded portion. The inner placket 114 can also include a support layer 618 (shown in dotted line in FIG. 6) positioned between the outer layer 602 and the inner layer 604. In some embodiments, only the support layer 706 in the outer placket 112 is present, in other embodiments, only the support layer 618 in the inner placket 114 is present, and in still other embodiments, both support layers are present. Support layers 706 and 618 can extend a full or partial length of the respective plackets 114 and 112. For example, the support layers 706 and 618 can extend a length of the respective plackets 114 and 112 from a base of the respective placket 114 and 112 upwards past all of the concealed fasteners 120 and 122 but may not extend to the lowest functional visible fastener 616. In certain embodiments, the support layers 706 and 618 can only extend past the lowest functional visible fastener 616.

The hole embroideries 124 (e.g., buttonhole stitching) can be sewn through the outer, inner, and support layers 702-706. The holes 128 (e.g., buttonholes) can be cut in a center of the hole embroideries 124 through the outer, inner, and support layers 702-706. The fasteners 116 can extend through the holes 128 to couple the outer and inner plackets 112 and 114. The hole embroideries 124 can protect or reinforce the material of the clothing 100 from damage when a separating force is applied to the outer and inner plackets 112 and 114.

The hole embroideries 126 can be sewn through the outer and support layers 702 and 706 of the outer placket 112. In certain embodiments, the hole embroideries 126 do not extend through the inner layer 704 of the outer placket 112. The hole embroideries 126 may not have holes, such as holes 128, cut through any of the outer, inner, and support layers 702-706 of the outer placket 112.

The non-functional visible fasteners 118 can be coupled to the outer layer 702 of the outer placket 112. The non-functional fastener 118 can be applied over the hole embroideries 126 in a manner that would be aesthetically the same as when the fasteners 116 are inserted through the holes 128. When viewed from the outside of the clothing 100 with coupled outer and inner plackets 112 and 114, the fasteners 116 and 118 would appear nearly indistinguishable.

The non-functional visible fasteners 118 can be sewn over the hole embroideries 126 using thread 707. The thread 707 can be sewn through the outer and support layers 702 and 706 of the outer placket 112, similarly to the hole embroideries 126. In certain embodiments, the thread 707 is not sewn through the inner layer 704.

The fasteners 122 can be coupled through the inner and support layers 704 and 706 of the outer placket 112. The fasteners 122 can include a stud 708 and an eyelet 710. The eyelet 710 can extend through the inner and support layers 704 and 706 to couple with the stud 708. The eyelet 710 can be positioned between the outer layer 702 and support layer 706 to not be exposed outside of the outer placket 112. In certain embodiments, the eyelet does not extend through the outer layer 702 of the outer placket 112.

Although FIGS. 6 and 7 illustrate an example outer and inner plackets 112 and 114, various changes may be made to FIGS. 6 and 7. For example, the amount and placement of the various components of the outer and inner plackets 112 and 114 can vary as needed or desired. Also for example, the fasteners 120 and 122 can be switched on the outer and inner plackets 112 and 114 where the socket 608 and the cap 610 are coupled through the inner and support layers 704 and 706 and the stud 708 and the eyelet 710 are coupled through the outer and inner layers 602 and 604.

Figure 8:
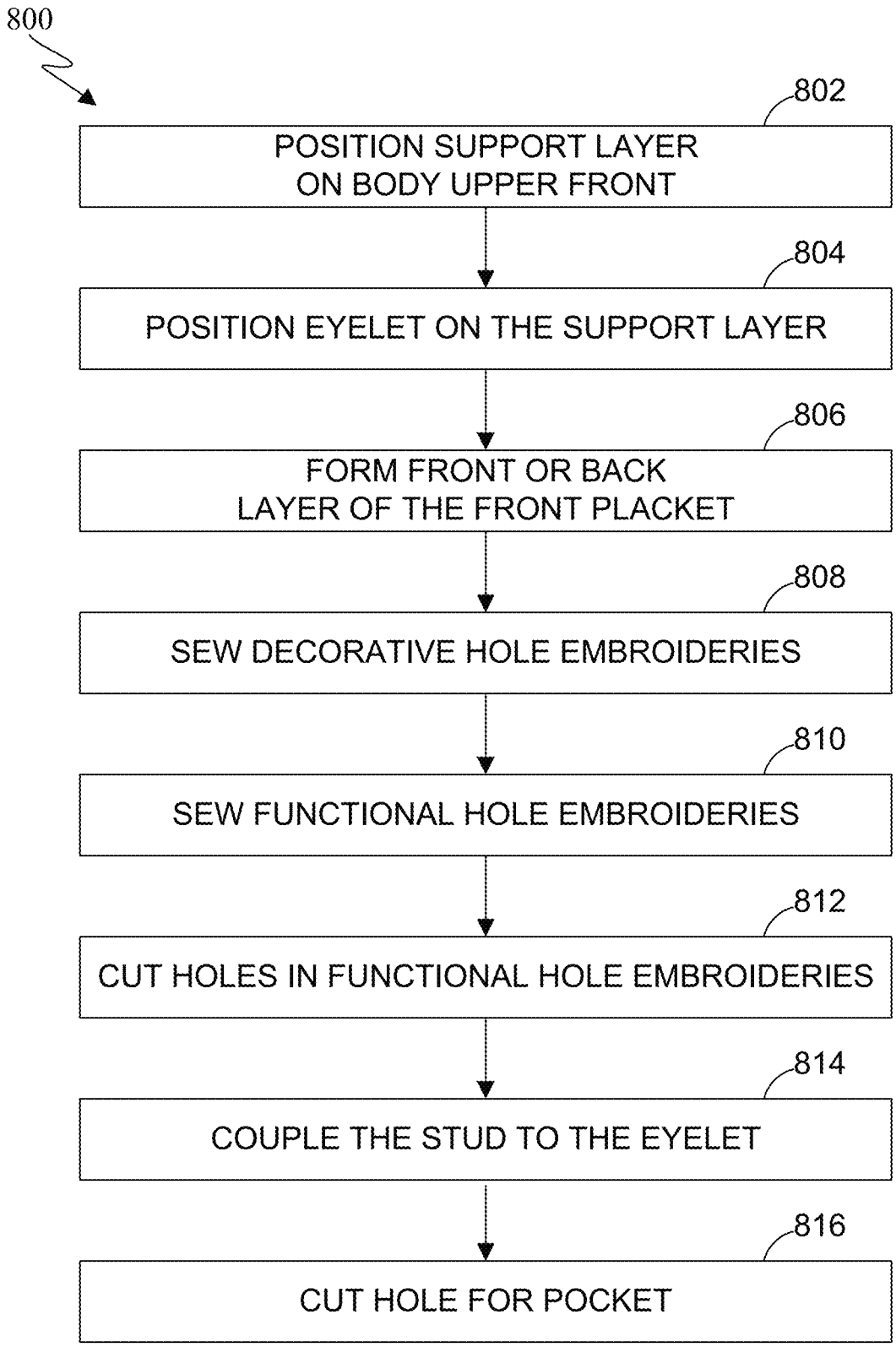
FIG. 8 illustrates an example method for manufacturing an outer placket for a concealed carry clothing in accordance with this disclosure.

FIG. 8 illustrates an example method 800 for manufacturing an outer placket 112 for a concealed carry clothing 100 in accordance with this disclosure. For ease of explanation, the method 800 of FIG. 8 is described using the clothing 100. However, the method 800 may be used to manufacture any other suitable clothing.

In operation 802, the support layer 706 is positioned on the outer body outer 102 of the clothing 100. The support layer 706 can provide an extra thickness for the outer placket 112 to support repeated forceable separating of the fasteners 120 and 122. The support layer 706 can be aligned with a leading edge of the outer body outer 102.

In operation 804, eyelet(s) 710 can be positioned on the support layer 706. The eyelets 710 can be centered on the support layer 706 and have an offset 132 from where the non-functional visible fasteners 118 are applied in operation 808. The eyelets 710 can be positioned between the support layer 706 and the outer layer 702 that is formed in operation 806.

In operation 806, the leading edge of the body outer front 102 is folded over the body outer front 102 to form the outer and inner layers 702 and 704 of the outer placket 112. Depending on a direction of the fold for the leading edge, the folded portion of the body outer front 102 can be either the outer layer 702 or the inner layer 704. A portion of the outer body outer 102 that is covered by the folded portion becomes the other layer of the outer layer 702 or the inner layer 704. The outer layer 702 corresponds to a layer of the outer placket 112 that is facing away from the inner placket 114 and the inner layer 704 corresponds to a layer of the outer placket 112 that is facing towards the inner placket 114.

In operation 808, the decorative (i.e., non-functional) hole embroideries 126 are sewn in the outer placket 112. For the non-functional hole embroideries, the folded layer can be temporarily pulled inner to sew through the outer and support layers 702 and 706. In some embodiments, the non-functional hole embroideries are not sewn through the inner layer 704 of the outer placket 112. In some embodiments, the non-functional hole embroideries 126 do not have holes cut through the center of the hole embroideries 126.

In operation 810, the functional hole embroideries 124 are sewn in the outer placket 112. The functional holes embroideries 124 extend through the outer, inner, and support layers 702-706 of the outer placket 112. The functional hole embroideries 124 can reinforce the material of the body outer front 102 from damage when the outer and inner plackets 112 and 114 are repeatedly forcibly separated.

In operation 812, the holes 128 are cut through a center of the functional hole embroideries 124. The holes 128 can extend through the outer, inner, and support layers 702-706 of the outer placket 112. The holes 128 allow the functional fasteners 116 to pass through the outer placket 112 to couple the outer placket 112 to the inner placket 114.

In operation 814, the stud 708 is coupled to the eyelet 710 through the inner and support layers 704 and 706 of the outer placket 112. The stud 708 can couple with the socket 608 on the inner placket 114 to couple the outer and inner plackets 112 and 114 together. When a separating force is applied to either of the outer or inner plackets 112 and 114, the stud 708 and socket 608 can be uncoupled, which allows an inner portion of the outer and inner plackets 112 and 114 to separate, while the functional fasteners 116 remain coupled and the remaining portion of the outer and inner plackets 112 and 114 remain coupled.

In operation 816, a hole 136 can be cut in the inner layer 704 of the outer placket 112 to form a pocket 134. The hole 136 can be cut near a bottom of the inner layer 704 of the outer placket 112. The hole 136 can allow item(s) to be placed in the pocket 134. The items in the pocket 134 can keep a bottom of the support layer from biasing away from the inner placket 112 when the outer and inner plackets 112 and 114 are coupled.

Although FIG. 8 illustrates an example method 800 for manufacturing an outer placket 112 for a concealed carry clothing 100, various changes may be made to FIG. 8. For example, while shown as a series of steps, various steps in FIG. 8 may overlap, occur in parallel, or occur any number of times. In addition, the various steps in FIG. 8 may be modified based on a type, weight, strength or material of the fabric of the clothing 100, based on types or locations of fasteners 116-122, and based on types, weights, strengths, materials or locations of the support layers 706 and 618, etc.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Although the present disclosure has been described with exemplary embodiments, various changes and modifications may be suggested to one skilled in the art. It is intended that the present disclosure encompass such changes and modifications as fall within the scope of the appended claims. None of the description in this application should be read as implying that any particular element, step, or function is an essential element that must be included in the claims scope. The scope of patented subject matter is defined by the claims.

What is claimed is:

1. An article of clothing comprising:

a body defining a body outer front portion, a body inner front portion and a collar;

the body outer front portion including an outer placket extending from the collar, the outer placket having a proximal portion located relatively closer to the collar and a distal portion located relatively farther from the collar;

the body inner front portion including an inner placket extending from the collar, the inner placket having a proximal portion located relatively closer to the collar and a distal portion located relatively farther from the collar;

a plurality of functional visible fasteners affixed to the proximal portion of the inner placket on a front side in a first spaced-apart arrangement along a first line;

a plurality of holes formed through the proximal portion of the outer placket in the first spaced-apart arrangement along a second line, wherein each of the plurality of holes is associated with a respective one of the plurality of functional visible fasteners;

wherein the plurality of functional visible fasteners is selectively engageable with the plurality of holes to couple the proximal portion of the inner placket to the proximal portion of the outer placket such that the first line and the second line are parallel to one another;

a plurality of non-functional visible fasteners affixed to the distal portion of the outer placket on the front side in a second spaced-apart arrangement along the second line;

wherein, when the plurality of functional visible fasteners is selectively engaged with the plurality of holes, the most distal one of the plurality of functional visible fasteners is in a third spaced-apart arrangement with the most proximal one of the plurality of non-functional visible fasteners; and at least one functional concealed fastener having an inner portion affixed to the distal portion of the inner placket on the front side and having an outer portion affixed to the distal portion of the outer placket on a back side;

wherein the inner and outer portions of each functional concealed fastener of the at least one functional concealed fastener are selectively engageable with one another to couple the distal portion of the inner placket to the distal portion of the outer placket;

wherein a location of the respective outer portion of the at least one functional concealed fastener is offset along the second line from any location of the non-functional visible fasteners; and wherein, when the plurality of functional visible fasteners is selectively engaged with the plurality of holes, the at least one concealed fastener is selectively releasable by pulling on one of the distal portions of the first and second plackets to separate the distal portions of the first and second plackets while the respective proximal portions of the first and second plackets remain coupled.

2. The article of clothing of according to claim 1, wherein the body is configured as a shirt; and wherein the plurality of functional visible fasteners are buttons of identical appearance;

wherein the plurality of non-functional visible fasteners are buttons having the identical appearance of the functional visible fasteners; and wherein the at least one functional concealed fastener comprises a two-part snap fastener.

3. The article of clothing of according to claim 2, wherein the at least one functional concealed fastener comprises at least two, two-part snap fasteners.

4. The article of clothing of according to claim 1, further comprising:

a first set of hole embroideries formed on the front side of proximal portion of the outer placket, each of the first set being associated with a respective one of the plurality of holes; and a second set of hole embroideries formed on the front side of distal portion of the outer placket, each of the second set being associated with a respective one of the plurality of non-functional visible fasteners.

5. The article of clothing of according to claim 4, wherein each of the second set of hole embroideries does not include a hole cut through a respective center of the embroidery.

6. The article of clothing of according to claim 1, further comprising a support layer of a material disposed between the front side and the back side of the outer placket.

7. The article of clothing of according to claim 6, wherein the respective outer portions of the at least one functional concealed fastener are affixed through the back side and the support layer of the outer placket, but are not affixed through the front side of the outer placket.

8. The article of clothing of according to claim 6, wherein the material of the support layer is one of:

a continuation of a back side material of the outer placket that is folded over on itself; and a continuation of a front side material of the outer placket that is folded over on itself.

9. The article of clothing of according to claim 8, wherein the material of the support layer is relatively stiffer than the back side material and the front side material.

10. The article of clothing of according to claim 1, further comprising:

a pocket disposed between the front side and the back side of the outer placket at a distal end of the outer placket; and wherein the back side of the outer placket is configured to form a passage to access the pocket.

* * * * *